US010333189B2

(12) United States Patent
Zhao et al.

(10) Patent No.: US 10,333,189 B2
(45) Date of Patent: Jun. 25, 2019

(54) TUNABLE FILTER

(71) Applicant: HUAWEI TECHNOLOGIES CO., LTD., Shenzhen, Guangdong (CN)

(72) Inventors: Qing Zhao, Xi'an (CN); Tao Tian, Shenzhen (CN); Jibin Zhou, Xi'an (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 36 days.

(21) Appl. No.: 15/625,353

(22) Filed: Jun. 16, 2017

(65) Prior Publication Data

US 2017/0288289 A1 Oct. 5, 2017

Related U.S. Application Data

(63) Continuation of application No. PCT/CN2014/094235, filed on Dec. 18, 2014.

(51) Int. Cl.
*H01P 1/207* (2006.01)
*H01P 1/208* (2006.01)

(52) U.S. Cl.
CPC ..... *H01P 1/207* (2013.01); *H01P 1/208* (2013.01)

(58) Field of Classification Search
CPC ..... H01P 1/2053; H01P 1/207; H01P 7/04; H01P 7/06; H01P 1/208
USPC ..... 333/202, 203, 206, 207, 222–226
See application file for complete search history.

(56) References Cited

U.S. PATENT DOCUMENTS 4,761,625 A 8/1988 Sharma
4,990,871 A 2/1991 Reindel
5,808,528 A 9/1998 Griffith
7,009,470 B2 3/2006 Yatabe et al.
(Continued)

FOREIGN PATENT DOCUMENTS

CN 102804484 A 11/2012
CN 103891041 A 6/2014
(Continued)

OTHER PUBLICATIONS

Machine English Translation of JP2013128210A published on Jun. 27, 2013.*
(Continued)

*Primary Examiner* — Rakesh B Patel
*Assistant Examiner* — Jorge L Salazar, Jr.
(74) *Attorney, Agent, or Firm* — Staas & Halsey LLP

(57) ABSTRACT

A tunable filter includes a first waveguide body, a second waveguide body, a metal plate, a tuning piece, and a driving piece. A first cavity is disposed in the first waveguide body, and a second cavity is disposed in the second waveguide body. The metal plate is sandwiched between the first waveguide body and the second waveguide body, multiple windows are disposed on the metal plate, and the first cavity and the second cavity are in communication and are symmetrically distributed on both sides of the metal plate. The tuning piece includes a dielectric pull-rod and multiple metal sheets connected to the dielectric pull-rod, the dielectric pull-rod protrudes out of the first waveguide body and is connected to the driving piece, the multiple metal sheets are disposed inside the first cavity, and the multiple metal sheets are disposed corresponding to the multiple windows.

12 Claims, 3 Drawing Sheets

(56) References Cited

U.S. PATENT DOCUMENTS

| | | | | |
|---|---|---|---|---|
| 7,205,868 | B2 * | 4/2007 | Park | H01P 1/205 333/203 |
| 7,456,711 | B1 | 11/2008 | Goldsmith | |
| 2004/0017272 | A1 | 1/2004 | Smith et al. | |
| 2005/0040916 | A1 | 2/2005 | Park et al. | |
| 2011/0084783 | A1 | 4/2011 | Jinnai | |
| 2012/0126914 | A1 | 5/2012 | Miyamoto et al. | |
| 2012/0229233 | A1 | 9/2012 | Ito | |
| 2015/0155610 | A1 | 6/2015 | Furukawa | |
| 2016/0118702 | A1 | 4/2016 | Xu | |

FOREIGN PATENT DOCUMENTS

| | | | |
|---|---|---|---|
| EP | 0 948 078 | A2 | 10/1999 |
| EP | 1291955 | A1 | 3/2003 |
| EP | 1 469 548 | A1 | 10/2004 |
| EP | 2448060 | B1 | 8/2013 |
| JP | 2008283617 | A | 11/2008 |
| JP | 2011009806 | A | 1/2011 |
| JP | 2013128210 | A | 6/2013 |
| WO | 2011134497 | A1 | 11/2011 |
| WO | 2013187139 | A1 | 12/2013 |

OTHER PUBLICATIONS

Extended European Search Report dated Nov. 28, 2017 in corresponding European Patent Application No. 14908200.0.

International Search Report dated Jun. 29, 2015 in corresponding International Application No. PCT/CN2014/094235.

Chinese Office Action dated Aug. 23, 2018 in corresponding Chinese patent Application No. 201480081118.X, 8 pgs.

Office Action, dated Apr. 1, 2019, in Chinese Application No. 201480081118.X (8 pp.).

* cited by examiner

TUNABLE FILTER

CROSS-REFERENCE TO RELATED APPLICATIONS

This application is a continuation of International Application No. PCT/CN2014/094235, filed on Dec. 18, 2014, the disclosure of which is hereby incorporated by reference in its entirety.

TECHNICAL FIELD

The present invention relates to the field of filter technologies, and in particular, to a tunable filter.

BACKGROUND

As wireless communication develops, a requirement for a microwave filter increases. To meet different application environments, different filter structures appear. A tunable cavity filter is widely applied to a communications system due to its features such as a low passband insertion loss, high stopband inhibition, tuning convenience, and a relative high power processing capacity.

For an E-plane filter, by means of precision control over a diaphragm, a frequency adjustment screw and a coupling adjustment screw may be cancelled, and commissioning of the filter is not required, which helps implement a tunable structure of a high-frequency microwave filter. A structure of an E-plane filter in the prior art is: a metal plate and a dielectric slice are disposed inside a rectangular waveguide tube, and a motor is used to drive the dielectric slice to move, to change a relative position relationship between the dielectric slice and the metal plate, so as to adjust a frequency of the filter. However, the dielectric slice in the structure of this type of E-plane filter is in an integral sheet-like structure, the dielectric slice stretches across a resonant cavity inside the rectangular waveguide tube of the filter, and the dielectric slice has a very low requirement for a dielectric constant. Such a dielectric slice has a very small thickness, is hard in manufacturing, and is poor in process reliability. In addition, because the dielectric slice has relatively weak hardness, a shock resistance capability is poor when the dielectric slice is assembled in the E-plane filter. Because a shock of the E-plane filter easily causes a position change of the dielectric slice, performance of the E-plane filter is affected. As a result, a frequency and performance of the E-plane filter are unstable.

SUMMARY

An objective of an embodiment of the present invention is to provide an E-plane tunable filter having good process reliability, and a frequency and performance of the E-plane tunable filter have good stability.

The embodiment of the present invention provides a tunable filter, including a first waveguide body, a second waveguide body, a metal plate, a tuning piece, and a driving piece, where a first cavity is disposed in the first waveguide body, a second cavity is disposed in the second waveguide body, the first waveguide body is in butt joint with the second waveguide body, an input end and an output end are formed on both ends of a juncture of the first waveguide body and the second waveguide body, and an electromagnetic wave in the tunable filter is propagated from the input end to the output end; the metal plate is sandwiched between the first waveguide body and the second waveguide body, multiple windows are disposed on the metal plate, the multiple windows are distributed along a propagation direction of the electromagnetic wave of the tunable filter, and the first cavity and the second cavity are in communication and are symmetrically distributed on both sides of the metal plate; the tuning piece includes a dielectric pull-rod and multiple metal sheets connected to the dielectric pull-rod, the dielectric pull-rod traverses the first waveguide body, the dielectric pull-rod protrudes out of the first waveguide body and is connected to the driving piece, the multiple metal sheets are disposed inside the first cavity, and the multiple metal sheets and the multiple windows are distributed in a same manner and are disposed in a one-to-one correspondence, to form a resonant cavity; and the driving piece drives the tuning piece to move relative to the metal plate, to change a size of the resonant cavity, so as to adjust a frequency of the tunable filter.

BRIEF DESCRIPTION OF DRAWINGS

To describe the technical solutions in the embodiments of the present invention more clearly, the following briefly describes the accompanying drawings required for describing the embodiments. Apparently, the accompanying drawings in the following description show merely some embodiments of the present invention, and a person of ordinary skill in the art may still derive other drawings from these accompanying drawings without creative efforts.

DESCRIPTION OF EMBODIMENTS

The following clearly describes the technical solutions in the implementation manners of the present invention with reference to the accompanying drawings in the implementation manners of the present invention.

The present invention relates to a tunable filter. In an implementation manner, the tunable filter provided in the present invention is a tunable band-pass filter. Further, the tunable filter provided in the present invention is a cuboid-shaped waveguide filter.

Figure 1:
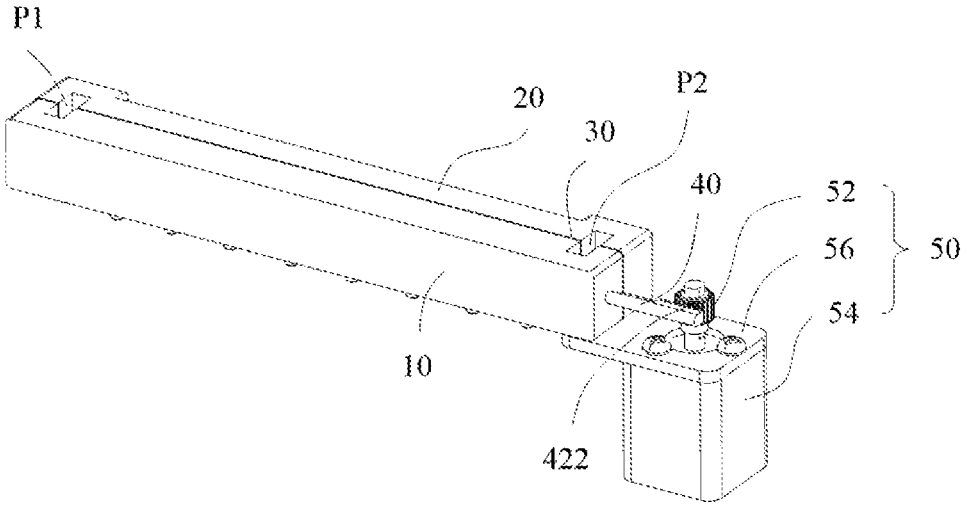
FIG. 1 is a three-dimensional schematic diagram of a tunable filter according to an implementation manner of the present invention.
Figure 2:
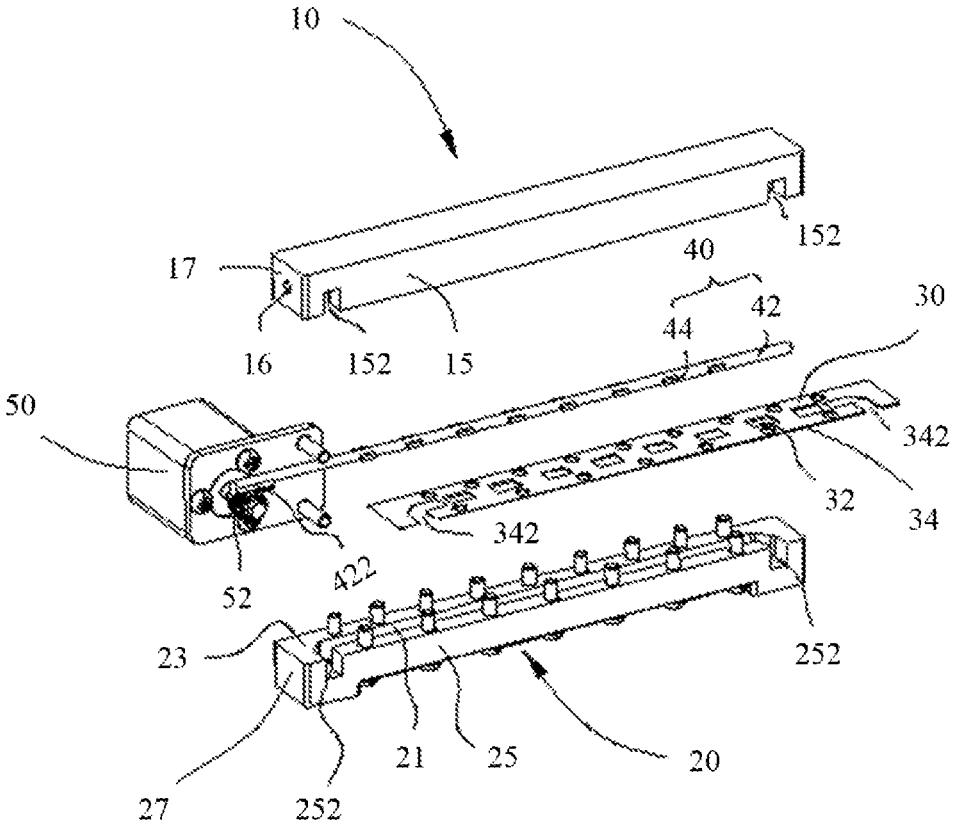
FIG. 2 is a three-dimensional exploded schematic diagram of a tunable filter from a first direction according to an implementation manner of the present invention.
Figure 3:
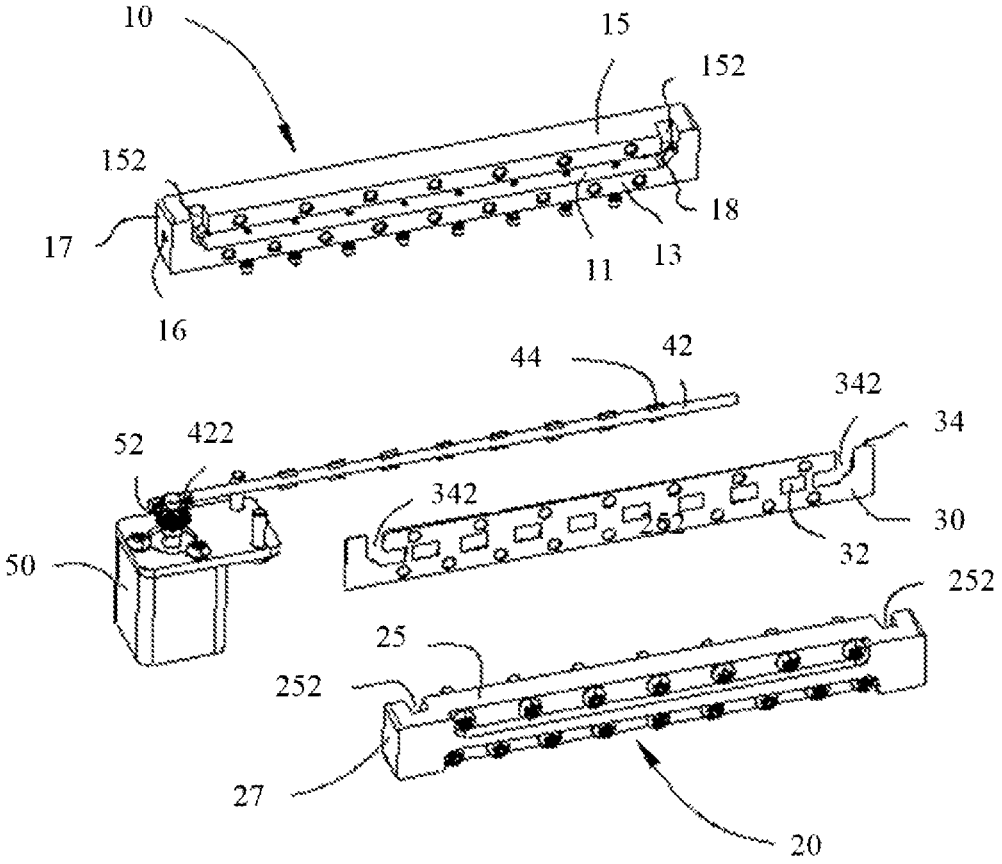
FIG. 3 is a three-dimensional exploded schematic diagram of a tunable filter from a second direction according to an implementation manner of the present invention.

For a detailed structure of the tunable filter in the present invention, refer to FIG. 1, FIG. 2, and FIG. 3. The tunable filter includes a first waveguide body 10, a second waveguide body 20, a metal plate 30, a tuning piece 40, and a driving piece 50.

A first cavity 11 is disposed in the first waveguide body 10. Specifically, in this implementation manner, the first waveguide body 10 is in a cuboid shape. In another implementation manner, a shape of the first waveguide body 10 is not limited to the cuboid shape, and may be a cylinder or another shape. The first waveguide body 10 includes a first butt-joint face 13 and a first interface face 15 that extend along a length direction of the first waveguide body 10, and the first butt-joint face 13 and the first interface face 15 are disposed to be adjacent and are perpendicular to each other. The first cavity 11 extends along the length direction of the first waveguide body 10, and the length direction of the first waveguide body 10 is a propagation direction of an electromagnetic wave of the tunable filter in the present invention. The first cavity 11 extends inwards the first waveguide body 10 from the first butt-joint face 13, and both ends of the first cavity 11 separately lead to the first interface face 15. That is, a notch 152 is disposed at each of both ends of the first interface face 15, and the two notches 152 are configured to enable an exterior of the first waveguide body 10 to communicate with the first cavity 11. Projection of the first cavity 11 on the first interface face 15 is a rectangle, but is not limited to a rectangle, and may also be a trapezoid or another shape. In another implementation manner of the present invention, the first waveguide body 10 is in a cylinder shape, the first cavity 11 extends along an axial direction of the first waveguide body 10, and the length direction of the first waveguide body 10 is a propagation direction of an electromagnetic wave of the tunable filter in the present invention.

The first waveguide body 10 further includes a first end face 17 perpendicularly connected between the first butt-joint face 13 and the first interface face 15. A first positioning hole 16 and a second positioning hole 18 are further disposed on the first waveguide body 10, where the first positioning hole 16 is communicated between the first end face 17 and the first cavity 11, and the second positioning hole 18 is opposite to the first positioning hole 16 and is located on a side of the first cavity 11 that is away from the first positioning hole 16. The second positioning hole 18 may be a blind hole or a through hole.

A second cavity 21 is disposed in the second waveguide body 20, and a structure and a shape of the second cavity 21 are the same as those of the first cavity 11. Specifically, in this implementation manner, the structure of the second waveguide body 20 is similar to that of the first waveguide body 10. The second waveguide body 20 includes a second butt-joint face 23 and a second interface face 25 that extend along a length direction of the second waveguide body 20, and the second butt-joint face 23 and the second interface face 25 are adjacent and perpendicular to each other. The second cavity 21 extends along the length direction of the second waveguide body 20, and the length direction of the second waveguide body 20 is the propagation direction of the electromagnetic wave of the tunable filter in the present invention. The second cavity 21 extends inwards the second waveguide body 20 from the second butt-joint face 23, and both ends of the second cavity 21 separately lead to the second interface face 25. That is, a notch 252 is disposed at each of both ends of the second interface face 25, and the two notches 252 are configured to enable an exterior of the second waveguide body 20 to communicate with the second cavity 21. The second waveguide body 20 further includes a second end face 27 perpendicularly connected between the second butt-joint face 23 and the second interface face 25. Projection of the second cavity 21 on the second interface face 25 is a rectangle.

The first waveguide body 10 is in butt joint with the second waveguide body 20, as shown in FIG. 1, an input end P1 and an output end P2 are formed at both ends of a juncture of the first waveguide body 10 and the second waveguide body 20, and the electromagnetic wave in the tunable filter is propagated from the input end P1 to the output end P2. Specifically, the first butt-joint face 13 is opposite to the second butt-joint face 23, and at the same time, the first cavity 11 is opposite to the second cavity 21. After butt joint, the first interface face 15 and the second interface face 25 are coplaner, and the first end face 17 and the second end face 27 are also coplaner. In addition, the two notches 152 on the first interface face 15 are respectively in butt joint with the two notches 252 on the second interface face 25. In this way, the input end P1 and the output end P2 are formed at the notches on the first interface face 15 and the second interface face 25.

The metal plate 30 is sandwiched between the first waveguide body 10 and the second waveguide body 20, that is, between the first butt-joint face 13 and the second butt-joint face 23. Multiple windows 32 are disposed on the metal plate 30, the multiple windows 32 are distributed along the propagation direction of the electromagnetic wave of the tunable filter, and the first cavity 11 and the second cavity 21 are in communication and are symmetrically distributed on both sides of the metal plate 30. The metal plate 30 is sandwiched between the first cavity 11 and the second cavity 21, to separate the first cavity 11 from the second cavity 21. However, because the multiple windows 32 are disposed on the metal plate 30, where the windows 32 may be, but not limited to, a rectangular structure, the first cavity 11 and the second cavity 21 are in communication with each other by using the multiple windows 32. The metal plate 30 is in a rectangular sheet-like structure, a long edge of the metal plate 30 is an interface edge 34, the multiple windows 32 are distributed in a middle position of two long edges of the metal plate 30 along a length direction of the metal plate 30, and a notch 342 is disposed at each of both ends of the interface edge 34 of the metal plate 30. After assembly, the notch 342 on the metal plate 30 is separately aligned with the notch 152 on the first waveguide body 10 and the notch 252 on the second waveguide body 20.

The first waveguide body 10 and the second waveguide body 20 are fixed by using multiple screws, or the first waveguide body 10 and the second waveguide body 20 are permanently connected in a manner of mucilage glue or welding. A vibration absorbing washer may also be disposed between the first waveguide body 10 and the second waveguide body 20. For example, the vibration absorbing washer is disposed at a joint of the first waveguide body 10 and the second waveguide body 20.

The tuning piece 40 includes a dielectric pull-rod 42 and multiple metal sheets 44 connected to the dielectric pull-rod 42. The dielectric pull-rod 42 traverses the first waveguide body 10. The dielectric pull-rod 42 protrudes out of the first waveguide body 10 and is connected to the driving piece 50. The multiple metal sheets 44 are disposed inside the first cavity 11, and the multiple metal sheets 44 and the multiple windows 32 are distributed in a same manner and are disposed in a one-to-one correspondence. As shown in FIG. 2 and FIG. 3, a quantity of the metal sheets 44 is eight, a quantity of the windows 32 is also eight, and both are distributed at regular intervals. The multiple metal sheets 44 are distributed on a same plane, and all the multiple metal sheets 44 are parallel to the metal plate 30. Specifically, in this implementation manner, one end of the dielectric pull-rod 42 passes through the first positioning hole 16 of the first waveguide body 10, and protrudes out of the first waveguide body 10, and the other end of the dielectric pull-rod 42 is positioned inside the second positioning hole 18 of the first waveguide body 10. The dielectric pull-rod 42 is in clearance fit with both the first positioning hole 16 and the second positioning hole 18, so that the dielectric pull-rod 42 can move relative to the first waveguide body 10.

The driving piece 50 drives the tuning piece 40 to move relative to the metal plate 30, that is, to change a position relationship between the tuning piece 40 and the metal plate 30, to adjust a frequency of the tunable filter. Specifically, in a process in which the driving piece 50 drives the dielectric pull-rod 42 to move, a position relationship between the metal sheets 44 and the corresponding windows 32 on the metal plate is changed, that is, the frequency of the tunable filter is changed. The multiple metal sheets 44 are disposed on the dielectric pull-rod 42 in a scattered manner, and an area of a single metal sheet 44 is small. Therefore, in an adjustment and functioning process, the metal sheets 44 have a relatively good shock resistance capability, and can ensure stability of working performance of the tunable filter.

According to the tunable filter provided in this embodiment of the present invention, process reliability is improved by designing a tuning piece 40 into an aggregate of a dielectric pull-rod 42 and multiple metal sheets 44 connected to the dielectric pull-rod 42. Compared with an integral dielectric slice in the prior art, because a single body of the multiple metal sheets 44 has a small area, the metal sheets 44 are easy in manufacturing and have a good shock resistance capability, thereby ensuring stability of a frequency and performance of the tunable filter.

A connection structure between the multiple metal sheets 44 and the dielectric pull-rod 42 is not limited to one type. In an implementation manner of the present invention, the multiple metal sheets 44 are bonded to one side of the dielectric pull-rod 42 by using gel. In another implementation manner, multiple grooves are disposed on the dielectric pull-rod 42, and the multiple metal sheets 44 are properly assembled with the multiple grooves respectively, to implement a fixed connection between the multiple metal sheets 44 and the dielectric pull-rod 42, where the multiple metal sheets 44 are located on one side of the dielectric pull-rod 42. In connection structures of the two implementation manners, the metal sheets 44 are located on one side of the dielectric pull-rod 42. In another implementation manner of the present invention, multiple grooves are disposed on the dielectric pull-rod 42, and the multiple metal sheets 44 respectively pass through the multiple grooves, so that each metal sheet 44 passes through the dielectric pull-rod 42. In this implementation manner, the metal sheets 44 are located on both sides of the dielectric pull-rod 42. Distribution of the metal sheets 44 on the both sides of the dielectric pull-rod 42 is not limited to one form. In this implementation manner, each metal sheet 44 is axisymmetrically distributed by using the dielectric pull-rod 42 as a central axis. In another implementation manner, a relationship between the metal sheets 44 and the dielectric pull-rod 42 may also be an asymmetric distribution manner, and a size of the metal sheets 44 protruding out of one side of the dielectric pull-rod 42 is less than a size of the metal sheets 44 protruding out of the other side of the dielectric pull-rod 42.

Specifically, thicknesses of all the multiple metal sheets 44 are less than or equal to 1 mm, and all the multiple metal sheets 44 are in a rectangular sheet-like structure. The dielectric pull-rod 42 is in a slender cuboid shape or a slender cylinder shape.

The multiple windows 32 are distributed on the metal plate 30 at regular intervals. For example, the multiple windows 32 are distributed on the metal plate 30 at equal intervals. A rule for distributing the multiple windows 32 on the metal plate 30 is the same as a rule for distributing the multiple metal sheets 44 on the dielectric pull-rod 42.

Figure 4:
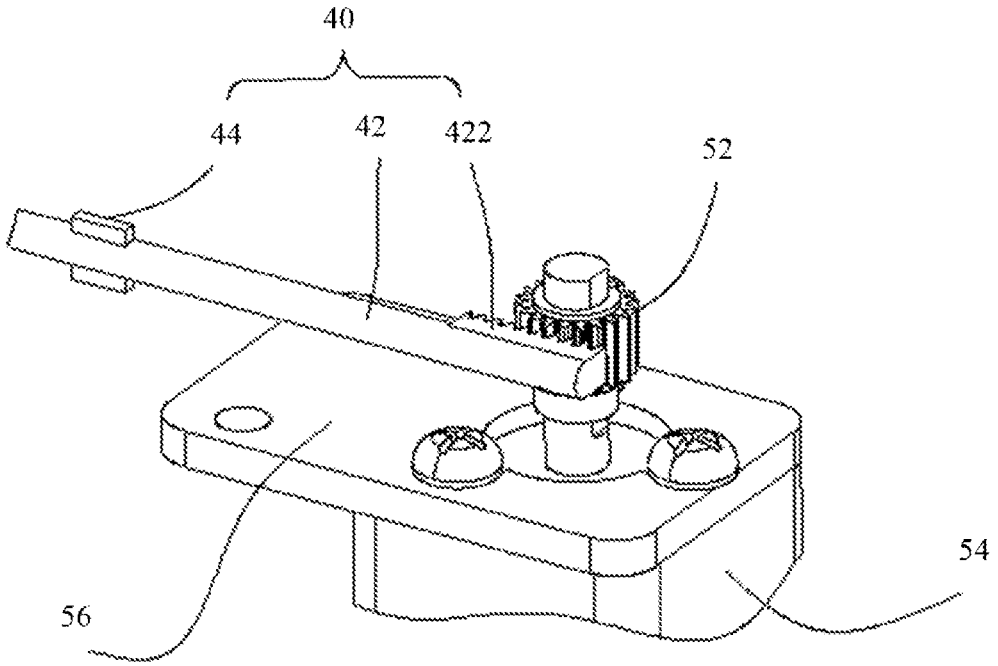
FIG. 4 is a partial schematic diagram of a structure in which a tuning piece and a driving piece of a tunable filter are used together according to an implementation manner of the present invention.

The driving piece 50 drives the dielectric pull-rod 42 to perform reciprocating motion along the propagation direction of the electromagnetic wave. Referring to FIG. 1 and FIG. 4, the driving piece 50 includes a gear 52, a stepper motor 54, and a mounting bracket 56. A gear rack 422 is disposed at one end of the dielectric pull-rod 42, and the gear rack 422 and the gear 52 are used together, to implement power transmission between the driving piece 50 and the dielectric pull-rod 42. The stepper motor 54 is configured to drive the gear 52 to rotate, and the gear 52 is disposed on an output shaft of the stepper motor 54. The mounting bracket 56 is fixed at one end of the stepper motor 54 by using a screw, and the mounting bracket 56 is configured to permanently connect to the first waveguide body 10 and the second waveguide body 20. In another implementation manner, linkage between the driving piece 50 and the dielectric pull-rod 42 may also be implemented by means of belt transmission or by using another linkage structure. The driving piece 50 may also be an air cylinder.

The foregoing descriptions are implementation manners of the present invention. It should be noted that a person of ordinary skill in the art may make certain improvements and polishing without departing from the principle of the present invention and the improvements and polishing shall fall within the protection scope of the present invention.

What is claimed is:

1. A tunable filter, comprising:

a first waveguide body, a second waveguide body, a metal plate, a tuning piece, and a driving piece, wherein a first cavity is disposed in the first waveguide body, a second cavity is disposed in the second waveguide body, the first waveguide body is in butt joint with the second waveguide body, an input end and an output end are formed on both ends of a juncture of the first waveguide body and the second waveguide body, and an electromagnetic wave in the tunable filter is propagated from the input end to the output end;

the metal plate is sandwiched between the first waveguide body and the second waveguide body, multiple windows are disposed on the metal plate, the multiple windows are distributed along a propagation direction of the electromagnetic wave of the tunable filter, and the first cavity and the second cavity are in communication and are symmetrically distributed on both sides of the metal plate;

the tuning piece comprises a dielectric pull-rod and multiple metal sheets connected to the dielectric pull-rod, the dielectric pull-rod traverses the first waveguide body, the dielectric pull-rod protrudes out of the first waveguide body and is connected to the driving piece, the multiple metal sheets are disposed inside the first cavity, and the multiple metal sheets and the multiple windows are distributed in a same manner and are disposed in a one-to-one correspondence; and the driving piece drives the tuning piece to move relative to the metal plate, to adjust a frequency of the tunable filter, wherein thicknesses of all the multiple metal sheets are less than or equal to 1 mm.

2. The tunable filter according to claim 1, wherein the multiple metal sheets are bonded to one side of the dielectric pull-rod by using gel.

3. The tunable filter according to claim 1, wherein the dielectric pull-rod is in a slender cuboid shape or a slender cylinder shape.

4. The tunable filter according to claim 1, wherein all the multiple metal sheets are in a rectangular sheet-like structure.

5. The tunable filter according to claim 1, wherein the multiple windows are distributed on the metal plate at regular intervals.

6. The tunable filter according to claim 1, wherein the driving piece drives the dielectric pull-rod to perform reciprocating motion along the propagation direction of the electromagnetic wave.

7. The tunable filter according to claim 1, wherein the driving piece comprises a gear, a gear rack is disposed at one end of the dielectric pull-rod, and the gear rack and the gear are used together, to implement power transmission between the driving piece and the dielectric pull-rod.

8. The tunable filter according to claim 7, wherein the driving piece comprises a stepper motor, and the gear is disposed on an output shaft of the stepper motor.

9. A tunable filter, comprising:

a first waveguide body, a second waveguide body, a metal plate, a tuning piece, and a driving piece, wherein a first cavity is disposed in the first waveguide body, a second cavity is disposed in the second waveguide body, the first waveguide body is in butt joint with the second waveguide body, an input end and an output end are formed on both ends of a juncture of the first waveguide body and the second waveguide body, and an electromagnetic wave in the tunable filter is propagated from the input end to the output end;

the metal plate is sandwiched between the first waveguide body and the second waveguide body, multiple windows are disposed on the metal plate, the multiple windows are distributed along a propagation direction of the electromagnetic wave of the tunable filter, and the first cavity and the second cavity are in communication and are symmetrically distributed on both sides of the metal plate;

the tuning piece comprises a dielectric pull-rod and multiple metal sheets connected to the dielectric pull-rod, the dielectric pull-rod traverses the first waveguide body, the dielectric pull-rod protrudes out of the first waveguide body and is connected to the driving piece, the multiple metal sheets are disposed inside the first cavity, and the multiple metal sheets and the multiple windows are distributed in a same manner and are disposed in a one-to-one correspondence; and the driving piece drives the tuning piece to move relative to the metal plate, to adjust a frequency of the tunable filter, wherein multiple grooves are disposed on the dielectric pull-rod, and the multiple metal sheets are properly assembled with the multiple grooves respectively, to implement a fixed connection between the multiple metal sheets and the dielectric pull-rod, wherein the multiple metal sheets are located on one side of the dielectric pull-rod.

10. A tunable filter, comprising:

a first waveguide body, a second waveguide body, a metal plate, a tuning piece, and a driving piece, wherein a first cavity is disposed in the first waveguide body, a second cavity is disposed in the second waveguide body, the first waveguide body is in butt joint with the second waveguide body, an input end and an output end are formed on both ends of a juncture of the first waveguide body and the second waveguide body, and an electromagnetic wave in the tunable filter is propagated from the input end to the output end;

the metal plate is sandwiched between the first waveguide body and the second waveguide body, multiple windows are disposed on the metal plate, the multiple windows are distributed along a propagation direction of the electromagnetic wave of the tunable filter, and the first cavity and the second cavity are in communication and are symmetrically distributed on both sides of the metal plate;

the tuning piece comprises a dielectric pull-rod and multiple metal sheets connected to the dielectric pull-rod, the dielectric pull-rod traverses the first waveguide body, the dielectric pull-rod protrudes out of the first waveguide body and is connected to the driving piece, the multiple metal sheets are disposed inside the first cavity, and the multiple metal sheets and the multiple windows are distributed in a same manner and are disposed in a one-to-one correspondence; and the driving piece drives the tuning piece to move relative to the metal plate, to adjust a frequency of the tunable filter, wherein multiple grooves are disposed on the dielectric pull-rod, and the multiple metal sheets respectively pass through the multiple grooves, so that each metal sheet passes through the dielectric pull-rod.

11. The tunable filter according to claim 10, wherein each metal sheet is axisymmetrically distributed by using the dielectric pull-rod as a central axis.

12. The tunable filter according to claim 11, wherein the multiple metal sheets are distributed on a same plane, and all the multiple metal sheets are parallel to the metal plate.

* * * * *